United States Patent [19]

Leone

[11] Patent Number: 4,984,932

[45] Date of Patent: Jan. 15, 1991

[54] APPARATUS FOR CONTINUOUS FORMATION OF CONCRETE CURBS

[76] Inventor: John Leone, 635 Hopkins Rd., Amherst, N.Y. 14221

[21] Appl. No.: 329,861

[22] Filed: Mar. 28, 1989

[51] Int. Cl.[5] ..... E01C 11/02

[52] U.S. Cl. ..... 404/72; 404/98; 425/64

[58] Field of Search ..... 404/72, 98; 249/2, 8, 249/157; 425/62, 63, 64

[56] References Cited

U.S. PATENT DOCUMENTS

| | | | |
|---|---|---|---|
| 3,261,272 | 7/1966 | Jennings | 404/98 |
| 3,685,405 | 8/1972 | McDonald et al. | 404/105 |
| 3,733,140 | 5/1973 | James | 404/98 |
| 3,779,661 | 12/1973 | Godbersen | 404/72 |
| 3,797,958 | 3/1974 | Lofarc | 404/98 |
| 3,820,913 | 6/1974 | Miller et al. | 404/98 |
| 3,915,583 | 10/1975 | Aparicio | 404/98 |
| 3,954,359 | 5/1976 | Larkin | 425/63 |
| 4,013,375 | 3/1977 | Heaton | 404/98 |
| 4,253,810 | 3/1981 | Bezhanov et al. | 425/64 |
| 4,280,800 | 7/1981 | Bunn | 425/64 X |
| 4,310,293 | 1/1982 | Eggleton et al. | 425/62 |
| 4,391,549 | 7/1983 | Murray | 404/87 |
| 4,566,823 | 1/1986 | May | 404/98 |
| 4,668,462 | 5/1987 | Smith | 249/157 X |

*Primary Examiner*—William P. Neuder

*Attorney, Agent, or Firm*—Bernard A. Chiama

[57] ABSTRACT

A curb forming apparatus is disclosed as having a concrete extruding mold device arranged for continuously receiving concrete and discharging the same to form a standard height curb. Elements of the mold device are connected to a power driven actuator and arranged to be raised and lowered for molding the concrete downwardly and upwardly to form thresholds for driveways and intermediate tapering sections for the transitions between the full height curbs and the thresholds.

4 Claims, 5 Drawing Sheets

APPARATUS FOR CONTINUOUS FORMATION OF CONCRETE CURBS

BACKGROUND OF THE INVENTION

The present invention relates to the formation of concrete curbs, and more particularly, to the formation of curbs adjacent driveways which normally interfere with their continuous preparation.

The conventional curb forming apparatus are devised with curb forming molds or "mules" which, during operation in producing curbs, are fixed for a job but may be moved vertically to some extent in conjunction with other equipment so that the mule will follow the contour of the road bed. When approaching a driveway, whether public or private, the host driving vehicle for the mule must be stopped, the pouring of concrete terminated, and the vehicle moved along to the other side of the driveway. A worker must be assigned the task of dressing the end of the curb so far produced as it joins the edge of the driveway.

This stop and repeat operation of the conventional curb forming apparatus is annoying, very time consuming and requires extra manpower to complete an average street. For an urban residential street wherein every house is provided with a driveway, considerable more funds are necessary to accomplish an acceptable performance of a curb forming operation.

In the prior art, such for example, as described in U.S. Pat. No. 3,797,958, a curb forming machine is disclosed as having a cut off plate which is moved horizontally with a mule so as to cut off the top portion of an extruded curb when moving across a driveway. However, this operation results in the accumulation of cut off curbing material upon the plate thereby necessitating the need of a workman to remove the material continuously from the plate during use. In addition, since the plate is cutting into the material, the resultant surface of the concrete curbing is unfinished, and the corners thereof will be roughened and irregular due to the occasional encountering of aggregate material. A different type of curb forming machine is described in U.S. Pat. No. 3,261,272 wherein a curb forming mold is adjustably supported. However, once this adjustment is made, it stays fixed. In view of the fact a reinforcing rod is included in a curb being formed, it would be impossible to effect stop and repeat operation needed when encountering driveways.

Other curb forming machines in the prior not endowed with provisions for the handling of driveways can be found in U.S. Pat. Nos. 3,733,140, 3,685,405, 3,820,913, 4,566,823, 4,391,549, 3,779,661, 3,954,359, and 4,310,293. In using the disclosed machines, the host driving apparatus for a curb forming mold must be stopped at each driveway encountered and special and time consuming effort must be expended thereat.

The present invention has been devised to overcome the difficulties and disadvantages discussed in the foregoing. To this end, an arrangement has been devised whereby a curb forming mule is adapted to be lowered gradually as the same approaches the oncoming edge of a driveway, this lowering working in conjunction with the movement of the driving vehicle which supports and drives the mule. As the mule lowers, the rear edge of the mule in contact the the top surface of the just molded curb gradually lowers therewith, thereby producing a downwardly tapering surface on plastic curbing material until the edge of the driveway is reached.

This downwardly tapering surface may be a flat planar surface, or curved depending upon integrated movement between the driving vehicle and the descent of the forming edge on the mule. As the driving vehicle continues its non-stop movement across the driveway with the mule in its lowermost position, concrete continues to be extruded from the mule to produce a low profile threshold across the entrance to the driveway which separates the main portion of the driveway from the street. As the driving vehicle approaches the other edge of the driveway, the reverse process is set in motion wherein the mule is gradually raised so the rear forming edge produces an upwardly tapering surface on the concrete which continues to be extruded from the mule as the vehicle continues its movement along the street. When the mule has been raised to its initial curb forming position now having passed the driveway, the normal curb forming operation continues until the next driveway in the path of the driving vehicle is encountered.

From the foregoing, it will be understood that the present invention provides continuous operation of a curb forming machine as the same progresses along a street lined with driveways. As each driveway is encountered, the curb forming mold is lowered to form a descending end to the curbing while the mold continues in its path of movement. In traversing the driveway, a low profile threshold of the curbing material is cast in the plane of the driveway until the other edge of the driveway is reached, whereupon the curb forming mold is raised slowly in conjunction with the movement of the mold along the street whereupon the mold is adapted to effect the upward formation of the curb starting from the edge of the driveway. This lowering and raising of the curb forming mold, as the same is moved along the side of the street to accommodate driveways, is accomplished without interrupting the movement of the flow of concrete into the mold so that a continuous curb producing operation is available.

Therefore, the principal object of the present invention is to produce street curbing, without interruption, along a street having many driveways entering the street.

Another object of the invention is cast plastic concrete across driveways as a continuous operation in conjunction the formation of curbs.

Still another object of the invention is to produce curbing along a roadway formed with driveways therealong without interrupting the movement of the curb forming machine.

Still another object of the invention is to integrate the formation of curbs to the presence of driveways along the path of curb formation.

Other objects and advantages will become apparent after reviewing the following description taken in conjunction with the accompanying drawings wherein:

PREFERRED EMBODIMENT OF THE INVENTION

Figure 1:
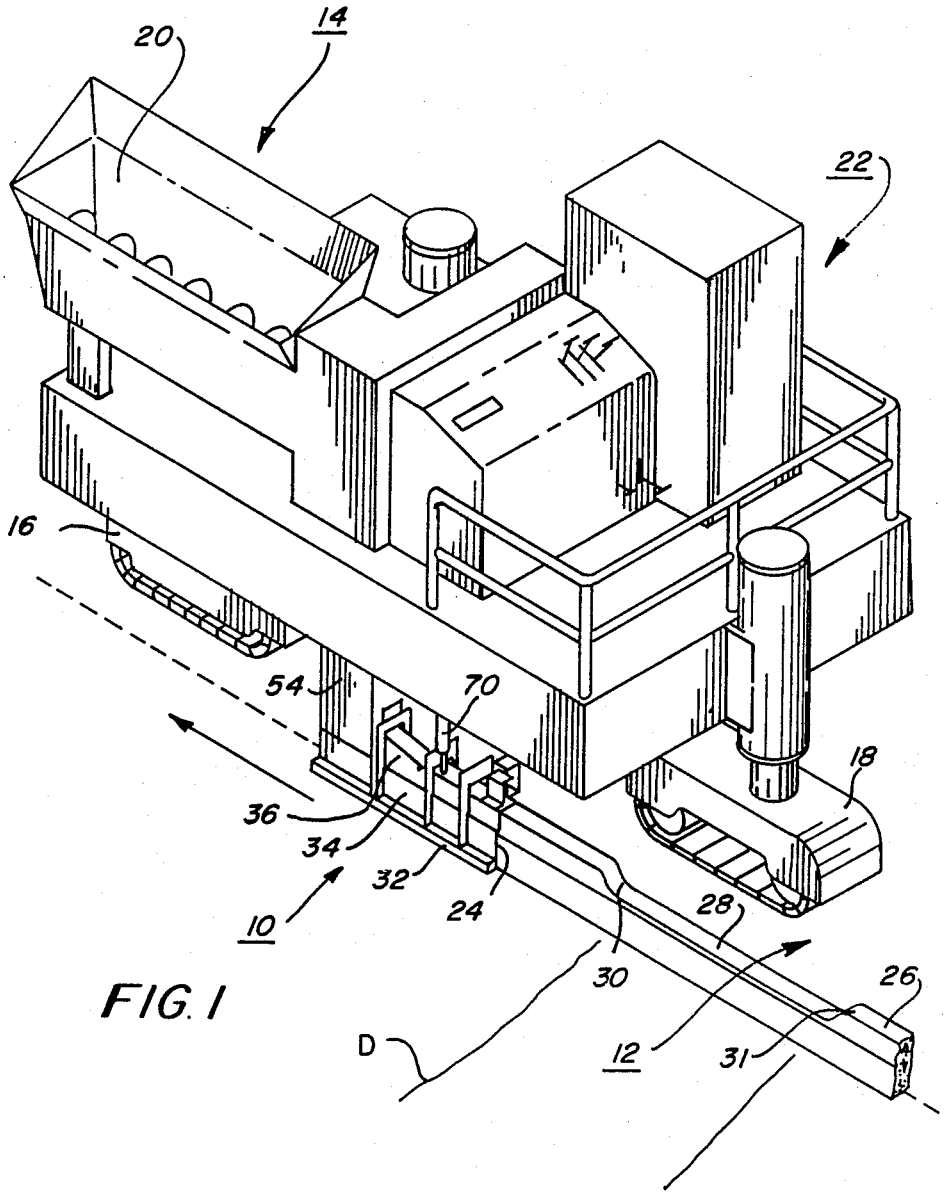
FIG. 1 is an isometric view of the present invention in conjunction with a host machine arranged to effect movement of the preferred embodiment.

The subject matter of the present invention, a curb forming apparatus or mule 10, is adapted to be moved along the side of a roadbed, street, road or the like 12, by a tractor machine, generally indicated by the reference number 14. Any other suitable driving means may be employed as a host for the curb forming apparatus. As shown in FIG. 1, the machine 14 includes two or more tractor devices 16, 18 which are driven on a roadbed, or the like, a concrete hopper 20 arranged to receive plastic concrete preparatory to the cast molding of a curb along the roadbed, and suitable power/motor devices 22 and controls therefor, for controlling full operation of the machine 14.

Depending from and along one side of the machine 12, the curb forming apparatus 10 is devised to receive plastic concrete at one end, and as the concrete is extruded out the output end thereof 24 to form a standard height curb 26, a threshold 28, which separates a driveway D and the roadbed 12 and generally in the same plane as the driveway (see FIG. 5), and tapering sections 30, 31 which separate the threshold 28 and the main curb 26. The sections 30, 31 may be formed with shapes other than a taper and curve, as will be described below.

Figure 2:
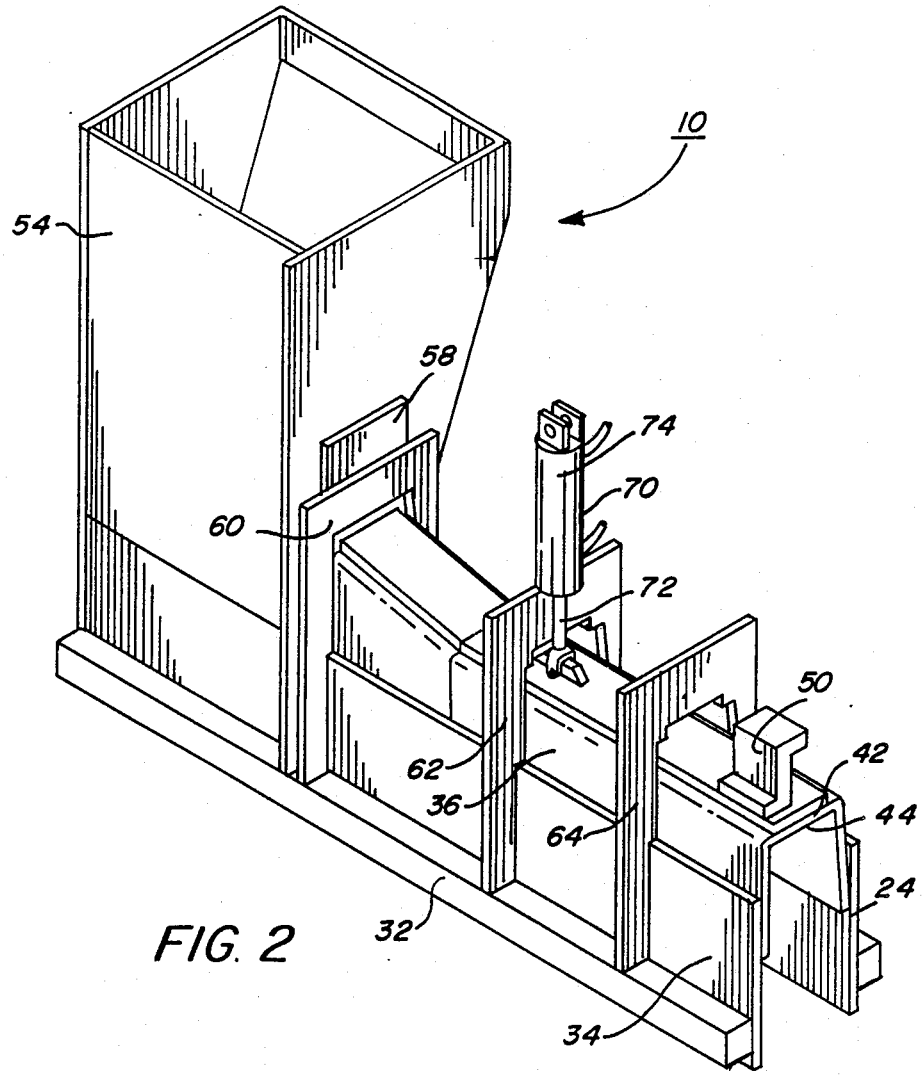
FIG. 2 is an isometric view of the curb forming apparatus or mule as devised in accordance with the present invention.
Figure 5:
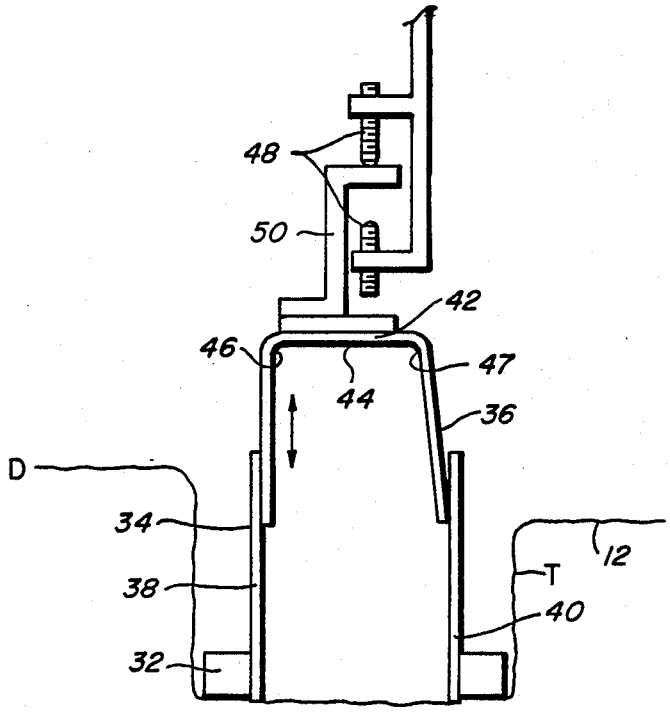
FIG. 5 is a cross-sectional view of the mule along a transverse line.

As shown in FIG. 1, the machine 14 is moving in the direction denoted by the arrow, with the apparatus 10 having finished a stretch of curb and a threshold. As the mule 10 is moved by the driving action of the host machine 14, plastic concrete is extruded out of the end 24 to form the curb, threshold and sections 30, 31. The mule 10, as shown in FIGS. 2 and 5, includes a frame 32 upon which is mounted an elongated curb molding device comprising a lower member 34 and an inverted U-shape upper member 36 arranged in sliding, telescoping manner relative to the member 34.

The lower member 34 is formed with vertical side plates 38, 40 arranged generally in parallel and secured at their lower edges to the frame 32. The upper member 36 slides vertically within the lower member and has an internal shape to conform to the desired cross-sectional shape of the curb. As shown in FIG. 5, the upper member 36 is formed with an upper plate 42 having a forming edge 44 which defines the upper boundary of the extrusion end 24 and rounded corners 46, 47 of slightly differing radii of curvature, indicative of the desired corners to be formed on a finished curb.

In forming a curb, the lower member 34 remains stationary and serves to cast the plastic concrete within a previously dug trench T in the roadbed and thereby become the footing for the curb. As will be described below, the upper member is driven upwardly and downwardly within the lower member as the mule 10 is driven along the roadbed, thereby forming the curb 26, the sections 30, 31 and the threshold 28 during the continuous movement of the mule and as driveways are encountered. The extent of vertical movement of the upper member 36 determines the desired height of the curb being extruded out of the mold and this distance may be adjusted by upper and lower set screws 48 mounted on the frame for the apparatus 10, engageable with a bracket 50 secured to the top of the member 36.

Plastic concrete material is driven into the mold casting device comprising the members 34, 36 by way of a hopper 54 mounted on the frame 32 and forming a part of the mule 10. The hopper 54 receives the concrete material from the hopper 20 on the machine 14, and is arranged to provide the concrete to the input end of the curb forming apparatus 10. The hopper 54 preferably includes vibrating devices (not shown) to assist in conveying the concrete into the mold casting device comprising the members 34, 36.

Figure 3:
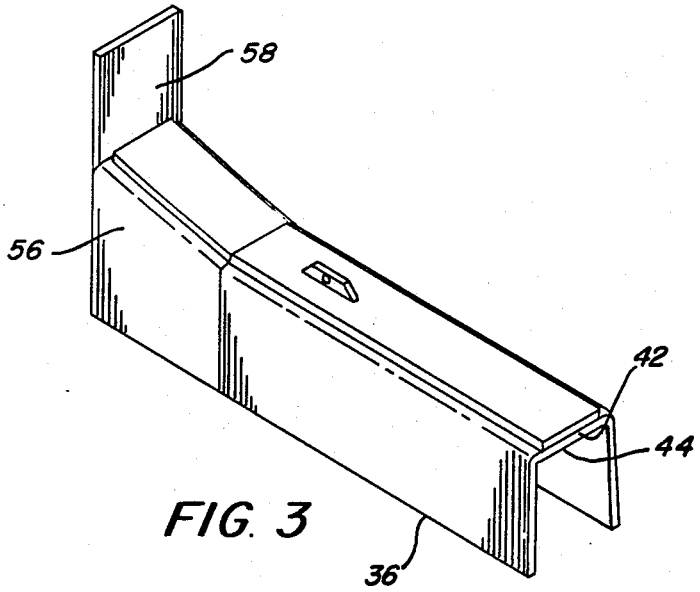
FIG. 3 is an isometric view of the mule or mold device for the invention.
Figure 4:
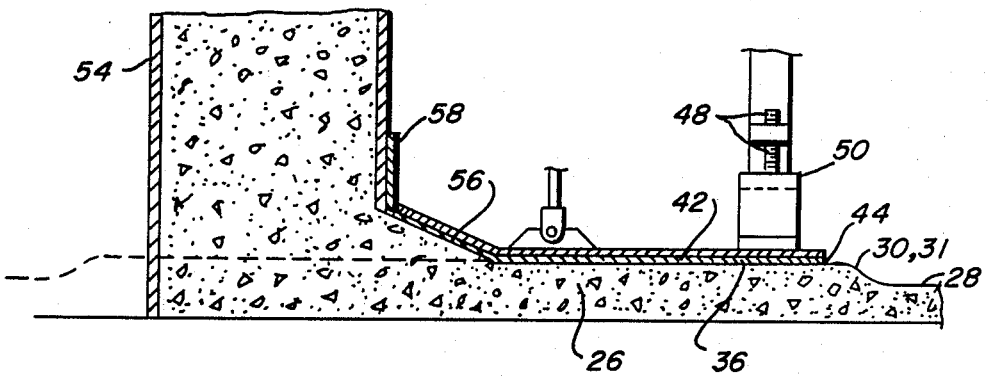
FIG. 4 is a cross-sectional view of the mule as applied to a curbing.

As shown in FIGS. 3 and 4, the end of the upper mold member 36 is formed with an upwardly flared end 56 which opens into the hopper 54 for initially receiving concrete material and directing the same into the mold members 34, 36. The flared end 56 terminates into an upstanding plate 58 which slides behind an inverted U-shaped element 60 secured to the frame 32, thereby serving to secure the upper member against longitudinal dislodgement during use. A pair of inverted and parallel U-shaped plates 62, 64 are also secured to the frame 32 in spaced arrangement to each other and to the element 60. The plates 60, 62, 64 serve to guide and to limit the upper movement of the mold member 36.

Upper and lower vertical movement is imparted to the upper mold member 36 by a hydraulic ram 70 having its piston 72 pivotally connected to the upper plate 42 and its cylinder 74 pivotally connected to the frame of the tractor machine 14. Activation of the ram 70 either to extend or retract the piston rod 72 produces corresponding vertical movement of the upper mold member 36 within the lower member 34.

In operation, as the mule or curb forming apparatus 10 is moved along the roadbed in a curb forming operation, the ram 70 is fully retracted to position the upper mold member 36 in its uppermost position, as shown in FIG. 5. Plastic concrete within the mule hopper 54 is conveyed into the mold 34, 36 and extruded out the end thereof to form the curb 26. In this phase of operation, the plate 42 and the rounded surfaces on corners 46, 47 effect a smooth and finished surface on the curb. Upon encountering a driveway, the operator actuates the ram 70 to produce downward movement of the mold member 36 at a slow rate of motion as the machine 14 continues to drive the mule 10 along the roadbed.

Figure 6:
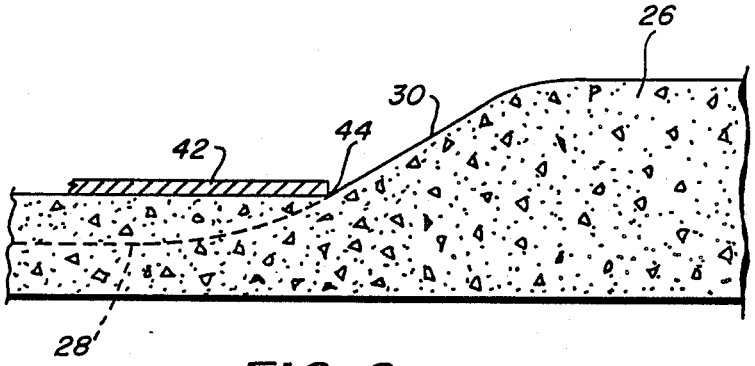
FIG. 6 is fragmentary view of the forming edge of the mule as it descends to a tapering surface.

Activation of the ram in this direction lowers the surface 42, and, in conjunction with the movement of the mule along the roadbed, produces a curved/tapered surface on the section 31 of the curb, as shown in FIG. 6. In this phase of operation, the forming edge 44 is driven downwardly to produce the curved/tapered surface as the surface 42 is lowered and moved to the left. The rounded surface 46, 47, coupled with the edge, produces a smooth and finished surface regardless of the presence of aggregate in the concrete.

After formation of the section 31, when the discharge end 24 of the mule reaches the edge of the driveway, the upper member 36 is at its lowest vertical position, having been lowered a total of six to eight inches, the industry standard for curb heights. Continued movement of the mule 10 along the roadbed forms the threshold 28 by the continual extrusion of concrete from the mule. Upon reaching the other side of the driveway, the operator actuates the ram 70 to retract the piston rod 72 at a slow rate of movement to effect the reverse movement of the upper member 36 thereby forming the upwardly tapering section 30. After completion of this section, the ram is deactivated to maintain the upper member in a fixed position, and the formation of the curb is allowed to continue.

Figure 9:
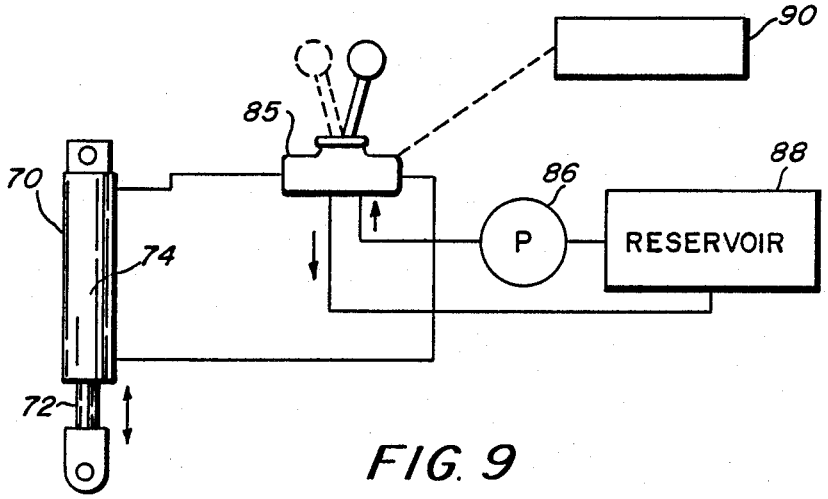
FIG. 9 is a schematic view of the control circuit for the operation of the present invention.
Figure 7:
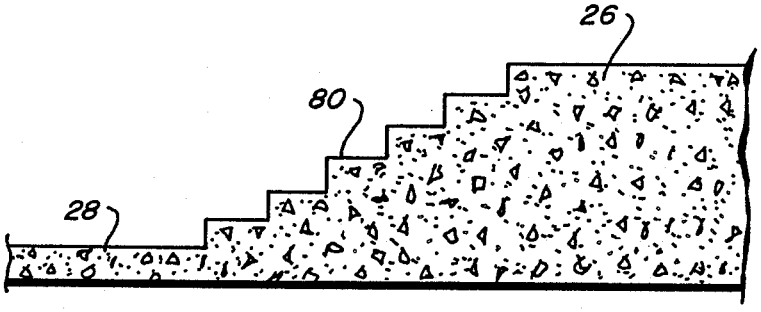
FIGS. 7 and 8 fragmentary views of other forms of curbing surfaces which can be formed with the present invention.
Figure 8:
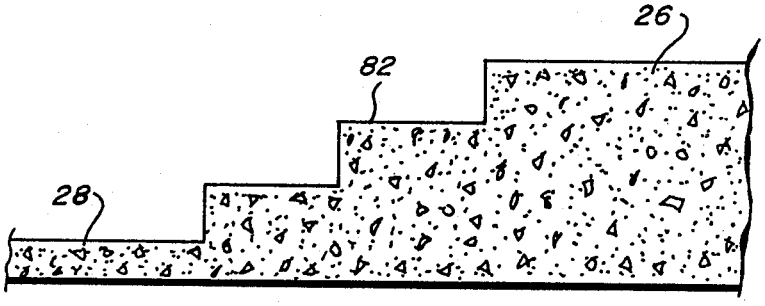

While the sections 30, 31 have been described as being tapered and/or curved, the present invention is adapted to produce various other surface formations for these sections. For example, in FIG. 7 there is illustrated a stepped surface 80 having a pattern of many short steps. In FIG. 8, a surface 82 is shown comprising a pattern of highly-steeped steps. These and other patterns may be produced depending upon the manipulation of the ram 70 by the operator. As shown in FIG. 9, the actuation of the hydraulic ram in either direction is made available by a manually operable valve mechanism 85 in the hydraulic system therefor. The mechanism 85 is suitably connected to the ram and a pump 86 having a reservoir for the supply and return of hydraulic fluid. An automatic control in the form of a computer microprocessor 90 may be connected to the hydraulic system for automatic control of the raising and lowering of the upper member 36 in accordance with the speed of the machine 14 as the same approaches and traverses a driveway, or with respect to a timing and distance function or combinations of either or both of these conditions with the movement of the machine 14.

The dimensions of the casting members 36,38 and the extent of vertical movement of the upper member 36 by the actuation of the ram 70 are such that, in addition to producing the tapered/curved surfaces 30,31, and the stepped surfaces 80,82, the members 36,38 may be utilized to produces different heights of curbing 26 along a roadbed. For example, curbs may be produced varying in height from 8 inches to 24 inches, depending upon the standards of the locality, by the adjustment of the upper member relative to the lower member utilizing the ram 70.

From the foregoing, it will be appreciated that the present invention enables the production of a curb along a roadbed lined with driveways, and to form thresholds and sloping approaches to the driveways without interruption to the operation of the apparatus involved in producing the curb. It will also be appreciated that the foregoing continuous production of the curb and driveway portions is adapted for manual or automatic control.

While the invention has been disclosed with reference to the structure disclosed, it is not confined to the details set forth but is intended to cover such modifications or changes as may come within the scope of the following claims.

What is claimed is:

1. A method of producing a curb along a roadbed along which are positioned driveways, comprising the steps of moving a multi-sided curb casting mold along the edge of the roadbed, extruding curbing material from said mold continuously along the roadbed before reaching a driveway from the discharge and of the molding device, lowering said molding device as the same approaches the oncoming edge of a driveway to form a generally downwardly top tapering top surface on the curb, moving said molding device across the driveway, raising said molding device after the same reaches the other side of the driveway to form a generally upwardly tapering top surface on the curb, and commencing formation of the curb.

2. Apparatus for the continuous formation of a curb on a side of a roadway, along which are positioned driveways, without disrupting the continuous movement thereof, comprising:

a mold casting device having a fixed lower member arranged for forming the footing of a curb and an upper member movable vertically relative to said lower member in telescoping manner arranged for forming the curb, said lower member having an open bottom through which curbing material is dispensed, said upper member having a top wall movable therewith, said top wall being arranged to define the top surface of the curb and being formed with a trailing edge adapted to slide along said top surface, means for supporting and moving said mold device continuously along the roadway, means for continuously supplying said mold device with curbing material as the same is moved along the roadway, and means for moving said upper member and said top wall vertically downwardly relative to said lower member as the same is moved toward the side of a driveway during movement of said support means along the roadway for downwardly tapering the top surface of the curb being cast adjacent said side of the driveway.

3. The apparatus as defined in claim 2 wherein said means for moving said upper member and said top wall is adapted for moving the same upwardly as said mold device is moved away from the other side of the driveway for producing an upwardly tapering top surface of the curb adjacent said other side of the driveway.

4. The apparatus as defined in claim 2 wherein said means for moving said top wall is adapted to produce stepped formations to said tapering top surface.

* * * * *